United States Patent [19]

Sterner

[11] 4,425,948

[45] Jan. 17, 1984

[54] WIRE WRAPPING TOOL

[75] Inventor: Eric Sterner, Hägersten, Sweden

[73] Assignee: Telefonaktiebolaget L M Ericsson, Stockholm, Sweden

[21] Appl. No.: 328,389

[22] Filed: Dec. 7, 1981

[30] Foreign Application Priority Data

Dec. 22, 1980 [SE] Sweden ..... 8009061

[51] Int. Cl.[3] ..... B21F 7/00

[52] U.S. Cl. ..... 140/119; 140/124; 242/7.17

[58] Field of Search ..... 140/119, 93 A, 57, 93.6, 140/93 R, 122, 123, 123.6; 242/7.17; 29/850, 861, 564.4, 566.3, 566.4

[56] References Cited

U.S. PATENT DOCUMENTS

Re. 26,791 2/1970 Etchison, Jr. et al. ..... 29/566.3

2,863,610 12/1958 Chambers et al. ..... 242/7.17

*Primary Examiner*—Francis S. Husar

*Assistant Examiner*—Linda McLaughlin

*Attorney, Agent, or Firm*—Hane, Roberts, Spiecens & Cohen

[57] ABSTRACT

Wire wrapping tool with a cylindrical wrapping bit which during its rotation carries a wire in a longitudinal groove so that the wire can be wound onto a tag located in the axial prolongation of a wrapping bit. The wrapping bit (6) is provided with a nozzle (9) which can rotate freely relatively to the wrapping bit and has an inclined hole (11). By inserting the end part of the wire into the hole (11) this is held by means of frictional engagement with the two opposite edge parts (13, 14) of the hole when turning the wrapping bit. When turning the nozzle relatively to the wrapping bit the end part of the wire is wound onto the tag and the wire is released.

4 Claims, 16 Drawing Figures

WIRE WRAPPING TOOL

FIELD OF THE INVENTION

The invention relates to a wire wrapping tool with a cylindrical wrapping bit which, during its rotation carries a wire in a longitudinal groove so that, during a simultaneous axial movement relatively to a tag situated in the axial prolongation of the wrapping bit the wire is wound onto the tag.

DESCRIPTION OF PRIOR ART

Wire wrapping tools of the mentioned kind are previously known and are used when a wire is to be wrapped around tags on a printed card in order to electrically connect them with each other. Irrespective of the wiring being made manually or by means of a machine, the end of the wire must be held by hand or by separate devices each time a new wire connection is started. Furthermore, after terminating the wiring, the protruding wire end fixed before must be cut close to the tag or bent in a further working step in order to be located close to the tag.

SUMMARY OF THE INVENTION

The aim of the invention is to provide a wire wrapping tool of the mentioned type where fixing of the end part of the wire during the wiring procedure and bending of the fixed wire part towards the tag is achieved after wiring without further auxiliary means and further working step.

This is achieved by providing the wrapping tool with a specially shaped nozzle through which the wire is lead.

BRIEF DESCRIPTION OF THE DRAWINGS

The invention will be closer described in detail below by means of an embodiment with reference to accompanying drawing on which.

the FIGS. 1*a*–1*j* schematically show different steps in a wiring process.

PREFERRED EMBODIMENT

Figure 1A:
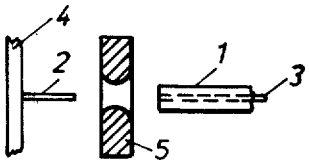
Figure 1B:
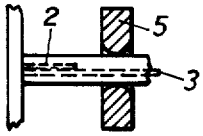
Figure 1C:
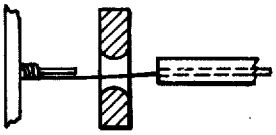
Figure 1D:
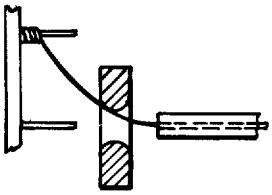
Figure 1E:
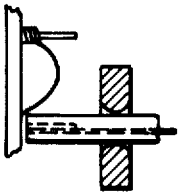
Figure 1F:
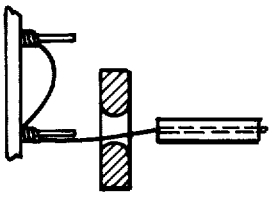
Figure 1G:
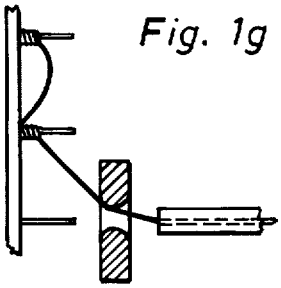
Figure 1H:
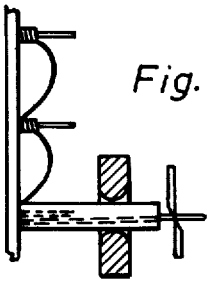
Figure 1J:
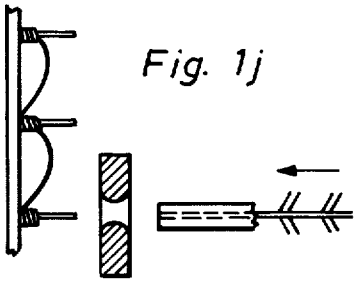

FIGS. 1*a*–1*j* show different steps in a wiring process connecting a number of tags. The wire wrapping tool 1 holds the wire 3 which is to be wrapped around a tag 2. From a position in front of the tag (FIG. 1*a*) the wire wrapping tool is displaced until it surrounds the tag which protrudes from a printed card 4 (FIG. 1*b*). A wire guiding means 5 is intended to guide the wire during the movement of the wire wrapping tool. After having wrapped the wire 3 onto the tag, the tool (FIG. 1*c*) is removed and moved to a position in front of the next tag onto which the wire is to be fastened (FIG. 1*d*). In the next step the tool is moved again to the printed card, the wire is wrapped and the tool is removed as in the preceding case (FIG. 1*f*) the process is repeated until the last tag in a wire connection (FIG. 1*g*) is reached. The tool is moved to the tag as in the preceding case but a wire length corresponding to the last wrapped part is cut inside the tool before the rotation of the wiring tool is started (FIG. 1*h*). In the last step the wiring tool is removed and the wire connection is ready (FIG. 1*j*). The described process is generally prevailing irrespective of how the end of the wire is fixed at the first tag. Such fixing is not shown on the drawing and implies a separate working step in earlier known devices irrespective of whether it is done manually or with separate devices. By using the tool according to the invention this extra working step is eliminated.

Figure 2:
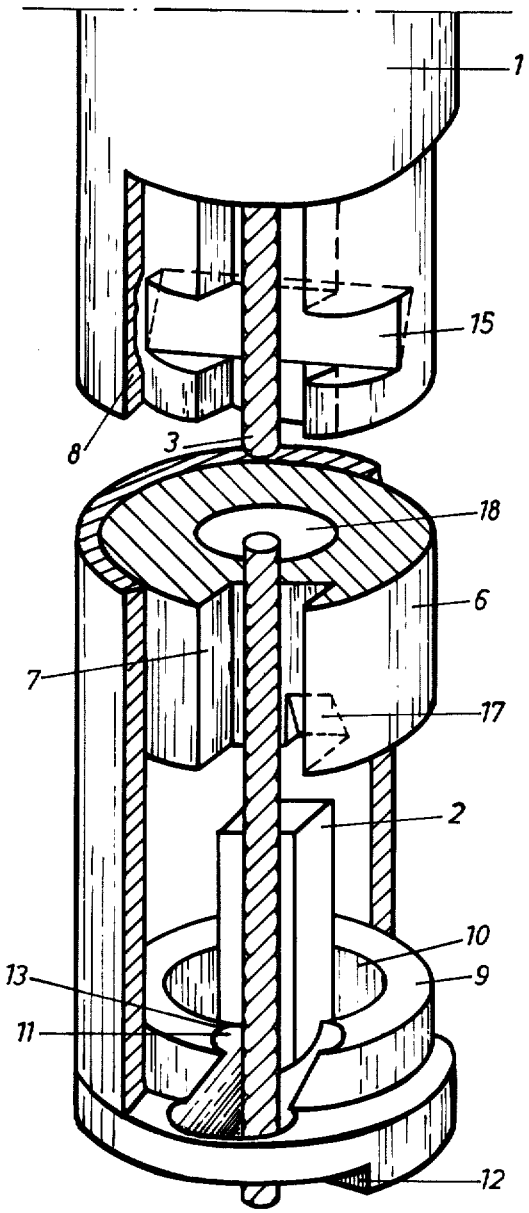
FIG. 2 shows the wire wrapping tool according to the invention on an enlarged scale and partly broken away in section.

FIG. 2 shows the wire wrapping tool 1 according to the invention substantially enlarged. A wrapping bit 6 is provided with a longitudinal groove 7 for the wire 3. The wrapping bit rotates in a cover 8 and carries the wire 3 in the groove at its periphery, so that the wire is unwound from a supply coil (not shown) and at the same time is wound onto the tag 2. With a wrapping bit of a conventional type, the end of the wire has to be held in a separate working step when the rotation of the wrapping tool has begun and in order to be relieved from this, the wrapping bit according to the invention is provided with a nozzle 9 which is fixed at the end of the cover 8. The nozzle has a central opening 10 which surrounds the tag with an interspace so that the tag with the wrapped wire has enough space in the opening. Furthermore, the nozzle 10 has a hole 11 which extends beside the central opening and has a sloping direction radially outwards as well as relative to the axis of the wiring tool. The nozzle has a notch 12 so when it is in contact with the printed card there is an interspace between the nozzle and the surface of the printed card. The hole 11 is arranged with its outer end in opening into this interspace. The hole 11 has a somewhat larger diameter than the wire 3, so that when the wrapping bit is turned and the hole 11 comes into axial prolongation with the groove 7, the wire can easily be threaded into the hole up to the surface of the printed card; but due to the slope of the hole it will be in contact with two sharp edges 13 and 14 situated on opposite sides of the hole 11. The slope of the hole relative to the axis of the wrapping bit is between 20°–40°, which is appropriate in order to hold the wire by the sharp edges upon rotation of the wrapping bit as will appear clearer in connection with FIG. 3. The wrapping bit is provided with conventional operating devices (not shown) in order to rotate the wrapping bit relative to the cover and furthermore to rotate the cover together with the nozzle when the wrapping bit is stationary. When the wire has been wound onto the tag, the end part of the wire which is in the hole 11 of the nozzle will be wound onto the tag through the rotation of the nozzle relative to the wrapping bit, so that the wiring tool is disengaged from the tag and can be removed as appears from FIG. 1*c*. The continued process does not differ from the conventional one, the supplying of the wire being done through the central opening 10 of the nozzle. The wrapping bit is provided with a groove 15 having an inclined bottom for cooperating with a cutting tool 16 in order to cut the wire before the wiring is carried out on the last tag in a wire connection. The wrapping bit is also provided with a groove 17 having sharp edges which strip the insulation from the wire during the wiring process. A hole for the tag 2 is shown at 18.

Figure 3A:
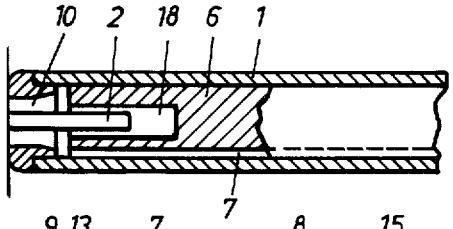
FIGS. 3*a*–3*f* show the wire wrapping tool according to the invention during different phases in the wiring process.
Figure 3B:
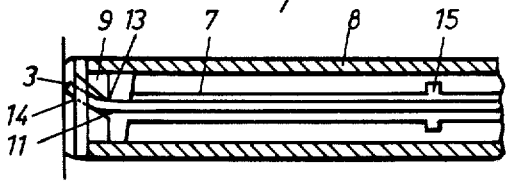
Figure 3C:
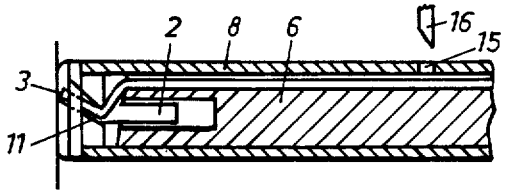
Figure 3D:
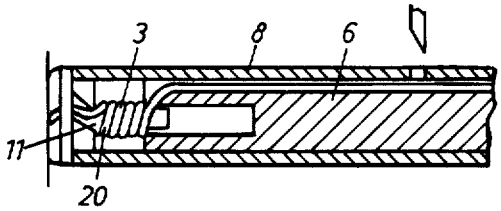
Figure 3E:
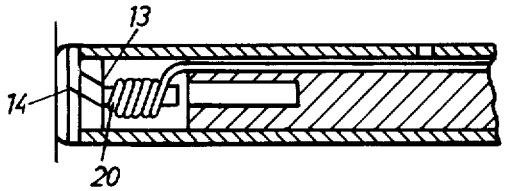
Figure 3F:
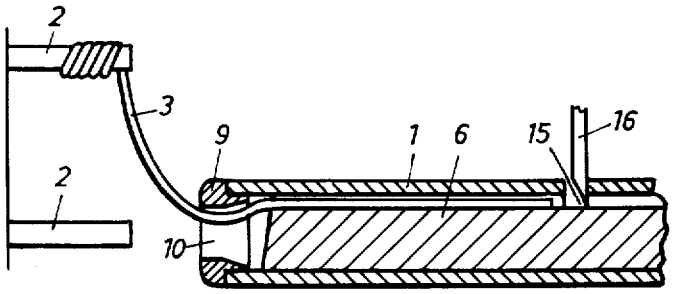

FIGS. 3*a*–3*f* show the wiring tool during different phases in the wiring process mainly at the first tag in connection. FIG. 3*a* is a longitudinal section through the wire wrapping tool 1 when it is pushed onto the tag 2. The hole 10 which is funnel shaped surrounds the tag with interspace and the groove 7 is shown partly in section. FIG. 3*b* is a view of the nozzle 9 and the wrapping bit 6 with the cover 8 in section. The wire 3 is threaded into the groove 7 and into the hole 11 which is located in the extension of the groove. The wire 3 is seen in contact with the two edge parts 13, 14 located on opposite sides of the hole 11. FIG. 3*c* shows the condition where the rotation of the wrapping bit has begun relative to the nozzle, the wire end being held at said sharp edges. FIG. 3*d* shows the condition where the rotation of the wrapping bit is terminated but the end part of the wire is held in the hole 11 of the nozzle. Now the rotation movement of the nozzle begins in the direction opposite to the earlier direction of the rotation movement of the wrapping bit so that the wire is released from the edges 13 and 14 at the same time as the insulation is stripped. This condition is shown in FIG. 3*e* from which it appears that the wire end 20 has been wound around the tag near the previously wound wire. In this condition the wire wrapping tool can be moved to a following tag as appears from FIG. 3*f*. The wire now passes through the central hole 10 of the nozzle. If it is the last tag in a wire connection, the wire is cut by means of the cutting tool 16 which cooperates with the groove 15 in the wrapping bit before the wiring can start.

Thus by the invention a simplification of the wiring process is achieved.

What we claim is:

1. A wire wrapping tool comprising a cylindrical wrapping bit adapted for longitudinally receiving a tag on which a wire is to be wound, said bit having a longitudinal groove offset from the tag for receiving a wire such that upon relative rotation of the bit and tag the wire is wound around the tag, said bit including a nozzle member freely rotatably relative to the bit, said nozzle member having a hole for receiving the wire extending from said groove, said hole in a particular relative angular position of said bit and nozzle member being in prolongation of said groove, said hole being inclined relative to said groove to provide offset edges for said hole which frictionally engage a free end of the wire in said hole to hold said free end when the wire is wound by the bit around the tag for a given member of turns whereas upon subsequent rotation of the nozzle member relative to said bit in the opposite direction the free end of the wire is wound onto the tag and the tool becomes disengaged from the wire.

2. A wire wrapping tool as claimed in claim 1 wherein said nozzle member is provided with a second central hole which, when the tool receives the tag, surrounds the tag with space for the wire turns.

3. A wire wrapping tool as claimed in claim 2 wherein said inclined hole has a slope of 20° to 40° relative to the longitudinal axis of the wrapping bit.

4. A wire wrapping tool as claimed in claim 3 wherein said inclined hole is inclined in said nozzle member radially outwards.

* * * * *